US006137423A

United States Patent [19]

Glorioso et al.

[11] Patent Number: 6,137,423

[45] Date of Patent: Oct. 24, 2000

[54] SYSTEM FOR COMMUNICATION WITH A REMOTE METER INTERFACE

[75] Inventors: Charles A. Glorioso, Castro Valley; Ali R. Naddaf, San Jose; Robert M. Russ, Jr., Los Altos Hills, all of Calif.; William W. Bassett, Edina, Minn.

[73] Assignee: Whisper Communications, Inc., Santa Clara, Calif.

[21] Appl. No.: 09/325,094

[22] Filed: Jun. 3, 1999

Related U.S. Application Data

[63] Continuation of application No. 08/874,684, Jun. 13, 1997, Pat. No. 5,914,672.

[51] Int. Cl.[7] ..... G08B 23/00

[52] U.S. Cl. ..... 340/870.02; 340/870.03; 340/870.11; 324/110; 455/426

[58] Field of Search ..... 340/870.02, 870.03, 340/870.11, 637, 539; 324/110; 375/206; 455/412, 426

[56] References Cited

U.S. PATENT DOCUMENTS

| | | | |
|---|---|---|---|
| 4,799,059 | 1/1989 | Grindahl et al. | 340/870.02 |
| 5,056,107 | 10/1991 | Johnson et al. | 375/1 |
| 5,432,507 | 7/1995 | Mussino et al. | 340/870.03 |
| 5,448,230 | 9/1995 | Schanker | 340/870.03 |
| 5,526,401 | 6/1996 | Roach, Jr. et al. | 455/426 |
| 5,546,444 | 8/1996 | Roach, Jr. et al. | 455/426 |
| 5,553,094 | 9/1996 | Johnson et al. | 375/200 |
| 5,748,104 | 5/1998 | Argyroudis et al. | 340/870.11 |
| 5,874,903 | 2/1999 | Shuey | 340/870.02 |
| 5,912,633 | 6/1999 | Allison et al. | 340/870.02 |

*Primary Examiner*—Michael Horabik
*Assistant Examiner*—Albert K. Wong
*Attorney, Agent, or Firm*—David R. Gildea

[57] ABSTRACT

A system for communication between multiple remote meter interfaces (RMI)s and a central office. The system includes multiple RMIs for reading meters and transmitting wireless data signals including meter readout information; multiple base repeater stations for receiving the wireless data signals where each particular base repeater station recognizes the wireless data signal only from particular RMIs that have been identified to the base repeater station, concentrates the information from the identified RMIS, and passes the concentrated information through a master base station and a wide area network (WAN) to a central office. The base repeater station includes a receiver for receiving the wireless data signal, a transmitter for passing concentrated information to the master station, and a microcontroller including an identification (ID) list including the IDs of the RMIs with which the base repeater station is enabled to communicate.

12 Claims, 3 Drawing Sheets

SYSTEM FOR COMMUNICATION WITH A REMOTE METER INTERFACE

This application is a continuation of patent application 08/874,684 by Glorioso and Naddaf entitled "System for Field Installation of a Remote Meter Interface" filed Jun. 13, 1997 now U.S. Pat. No. 5,914,672.

BACKGROUND OF THE INVENTION

1. Field of the Invention

The invention relates generally to systems for wireless communication between multiple remote meter interfaces (RMI)s and multiple base stations and more particularly to a system for field installation of a particular RMI to a particular base station.

2. Description of the Prior Art

Wireless communication systems are commonly used for sending information from remote locations to a central office. These systems include a remote interface for reading and transmitting information regarding a physical result and a communication network. Typically, the communications network includes local base stations situated on a grid for concentrating the information received in wireless signals from several remote interfaces and a wide area network (WAN) for forwarding the concentrated information to the central office. The WAN may use another wireless system or a wired system such as telephone landlines or cable television lines. The systems may be bi-directional to include the capability of sending control information from the office back to the remote interface. One important application for remote interfaces is for reading utility meters and transmitting the meter reading information in a wireless data signal. Such remote interfaces are known as appliance interface modules (AIM)s or remote meter interfaces (RMI)s.

It is likely that more than one base station will be situated near enough to an RMI to receive energy from the wireless data signal from that RMI. Although having multiple base stations receive the same wireless data signal may be used to provide redundancy, this use of the base stations and the WAN is less efficient because the same information will be sent multiple times. Further, complex software must be developed for the central office to deal with the multiple receptions the same information. The software will be especially complex in bidirectional systems where control information is sent back from the central office in response to the meter reading information. One solution to these problems is to designate a particular one of the base stations to communicate with each particular RMI so that the RMI can communicate only with that base station. In existing systems an identification for a designated RMI is downloaded via the WAN from the central office software to the base station. This identification is stored in the base station to designate an RMI with which the base station is enabled to communicate. However, it is sometimes difficult for a worker in the field who is installing or reinstalling an RMI to get control of the central office software in order to pass the identification through the WAN to the base station.

BRIEF SUMMARY OF THE INVENTION

It is therefore an object of the present invention to provide a method for field installation of a remote interface in a system having multiple remote interfaces and multiple base stations, whereby only one of the base stations is enabled in the field to recognize a wireless data signal from a particular remote interface.

Another object of the present invention is to provide a method for installing a particular remote interface to a particular base station without reducing the capacity of the base station for communicating with other remote interfaces.

Another object of the present invention is to provide a base station that may be enabled from the field to recognize a wireless data signal from a particular remote interface.

Another object of the present invention is to provide a system having an installer tool for enabling a base station to recognize a wireless data signal from a remote interface.

Briefly, a preferred embodiment of a system of the present invention includes multiple remote meter interfaces (RMI)s for reading meters and transmitting wireless data signals including meter readout information; multiple base stations for receiving the wireless data signals where each particular base station recognizes the wireless data signal only from particular RMIs that have been identified to the base station, concentrating the information from the identified RMIs, and passing the concentrated information to a central office through a wide area network (WAN); and an installer tool for transmitting a wireless installation signal to the particular base station for identifying the RMIs to the particular base station. The base station includes a receiver for receiving the wireless data signal, a transmitter for passing concentrated information to the WAN, and a microcontroller including an identification (ID) list including the IDs of the RMIs with which the base station is enabled to communicate.

An advantage of a field installation method of the present invention is that only one of the base stations is enabled to recognize a wireless data signal from a particular remote interface, thereby increasing the efficiency of the use of the airwaves, decreasing the cost of the system, and eliminating the need for software to deal with redundant information.

Another advantage of a method of the present invention is that a base station is enabled to communicate with a remote interface without reducing the time allocated for scheduled communications with other remote interfaces.

Another advantage of the present invention of a base station is that the base station may be enabled from the field to recognize a wireless data signal from a particular remote interface.

Another advantage of the present invention is that a system includes an installer tool for enabling a base station to recognize a wireless data signal from a remote interface.

These and other objects and advantages of the present invention will no doubt become obvious to those of ordinary skill in the art after having read the following detailed description of the preferred embodiments which are illustrated in the various figures.

DETAILED DESCRIPTION OF THE INVENTION

Figure 1:
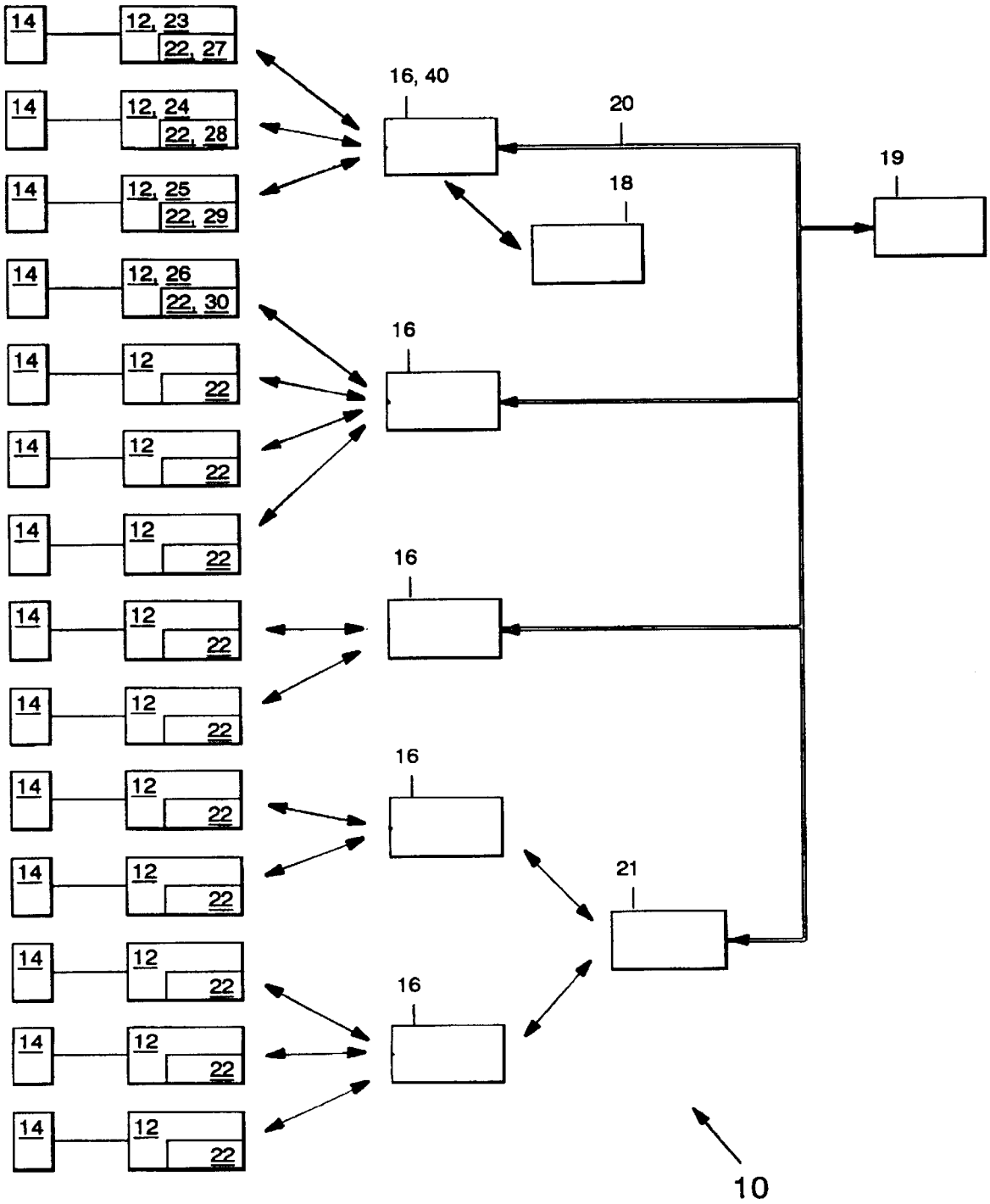
FIG. 1 is a block diagram of a system of the present invention whereby an installation tool enables a base station to communicate with a remote meter interface (RMI)

FIG. 1 illustrates a block diagram of a system of the present invention referred to by the general reference number 10. The system 10 includes multiple remote meter interfaces (RMI)s 12 for reading meters 14, multiple base stations 16 for receiving meter reading information by wireless signals from the RMIs 12, and an installer tool 18. The installer tool 18 is operated by a field repair or installation person for communicating by wireless signals to the base stations 16 for installing the RMIs 12 to the base stations 16. The meters 14 may be but are not limited to meters for measuring gas, water, electric flow, or the like; and sensors for measuring temperature, pressure, humidity, motion, contact closure, or the like.

Each of the base stations 16 concentrates the meter reading information from several of the RMIs 12 and then passes the information to a central office 19 via a wide area network (WAN) 20. Alternatively, the base stations 16 may act as repeaters to pass the meter reading information to a master station 21. The master station 21 then passes the information through the WAN 20 to the central office 19. Where the master station 21 is used, either or both of the base stations 16 and the master station 21 may concentrate the meter reading information. There may be more than one master station 21 in the system 10. In a preferred embodiment the RMIs 12, base stations 16, installer tool 18, and master station 21 communicate in signal bursts having thirty bytes per burst. A fast rate for the system is one burst per minute from one of the RMIs 12. It will be appreciated that at thirty bytes per minute, communication efficiency is of major importance in the system 10 and that redundant communications are to be avoided. In order to prevent redundant communications, the system 10 is designed so that each one of the RMIs 12 communicates with only one of the base stations 16. The RMIs 12 are identified, respectively, with a unique RMI ID 22. In a preferred embodiment the RMI ID 22 corresponds to the serial number of the respective one of the RMIs 12 that the RMI ID 22 identifies. Although any one of the RMIs 12 may be within range of several of the base stations 16, only the base station 16 that is enabled to recognize the RMI ID 22 of that one of the RMIs 12 will receive and respond to that one of the RMIs 12.

The WAN 20 may be wired or wireless and is commercially available from several sources including landline telephone companies such as Pacific Telesis Company, known as Pacific Bell of San Francisco, California, hybrid fiber optic and coax cable television companies, cellular telephone providers, cellular telephone providers having CDPD protocol for piggy backing digital data on an analog cellular telephone, and providers of specialized wireless services such as Metricom of Los Gatos, Calif.

Preferably, the wireless signals between the RMIs 12, the base stations 16, and the master station 21 in the system 10 are signal bursts within a carrier frequency range of 902 to 928 MHz. The communications are originated by the RMIs 12 and continued on a scheduled basis thereafter. During each signal burst, the carrier signal frequency hops in a pseudo-random sequence through fifty of one-hundred twenty-eight designated frequency channels within the frequency range. As a special case, the RMIs 12 that have not been installed before are allowed to use only three channels for installation. In operation, one of the RMIs 12 transmits a data signal burst to one of the base stations 16. The one of the base stations 16 receiving a data signal burst responds by transmitting a return signal burst. The round trip of the signal bursts is less than four-hundred milliseconds long in order to meet a Federal Communications commission (FCC) regulation for spread spectrum communication. The meter reading information is carried by frequency shift key (FSK) modulation at a rate of about two kilobaud and a deviation of about six kilohertz. The RMIs 12 and the base stations 16 for receiving and transmitting such wireless signals are disclosed in the U.S. Pat. No. 5,734,966 filed Jan. 20, 1995 by Farrer et al., incorporated herein by reference. Of course, other frequency ranges, signal formats, and modulation schemes could as well be used and the invention does not depend upon the specific frequency range, signal format, and modulation scheme described in the above U.S. patent.

In the description below, an exemplary group of the RMIs 12 designated as RMIs 23–26 having the RMI ID 22 designated as an RMI ID 27–30, respectively, have been installed at a previous time to an exemplary one of the base stations 16 designated as base station 40. The RMIs 23–24 are representative of the RMIs 12 that are actively communicating on a scheduled basis with base station 40; the RMI 25 is representative of the RMIs 12 that have been enabled to the base station 40 but are not actively communicating; and the 26 is representative of a particular one of the RMIs 12 that is to be installed to the base station 40 by the installer tool 18 according to the present invention.

Figure 2:
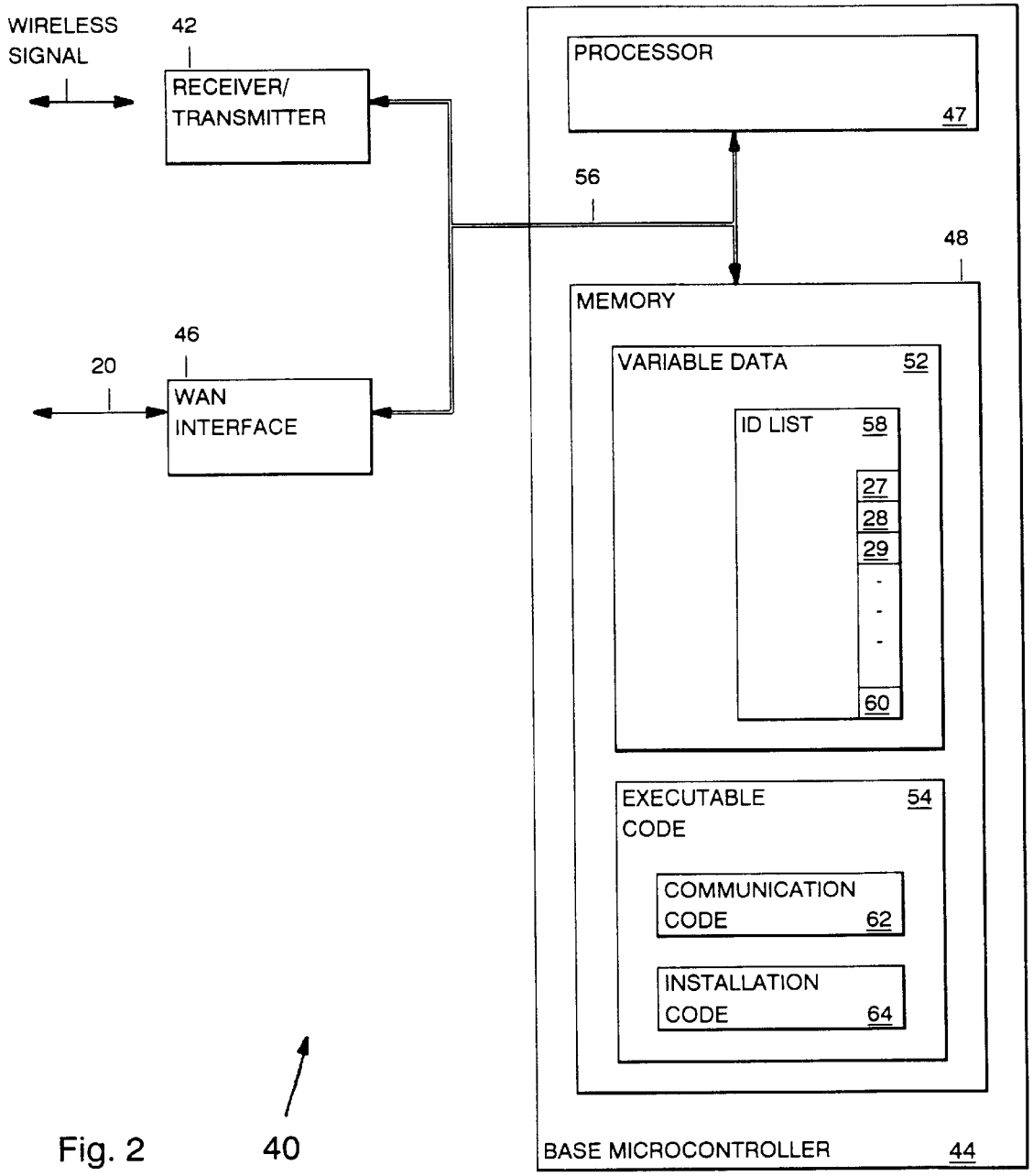
FIG. 2 is a block diagram of the base station of FIG. 1.

FIG. 2 is a block diagram of the particular base station 40 to which the particular RMI 26 (FIG. 1) is to be installed. The base station 40 includes a receiver/transmitter 42, a base microcontroller 44, and a WAN interface 46. The WAN interface 46 includes a serial interface and may include an additional interface that depends upon the particular type of the WAN 20 that is used for the system 10. In the case where the WAN 20 uses a hybrid fiber coax television network the WAN interface 46 includes a cable modem for modulating data on the RF carrier carried on the cable. For a telco dialup the WAN interface 46 includes a telephone modem. For the Metricom wireless network the WAN interface 46 includes a Ricochet wireless modem available from Metricom. For a cellular telephone the WAN interface 46 may include a CDPD modem.

The receiver/transmitter 42 includes all of the structural elements required for receiving and transmitting the wireless signals including one or more antennas, radio frequency filters, combiners, low noise amplifiers, power amplifiers, couplers, downconversion circuits, synthesizers, baseband filters, frequency discriminators, bit synchronizers, frame synchronizers, and gates. An example of such receiver/transmitter 42 operating in half-duplex with the same frequency for transmit and receive using direct up conversion from and down conversion to baseband is shown in the U.S. Pat. No. 5,734,966 referred to above. The receiver/transmitter 42 receives and transmits the wireless signal bursts over the air, and issues and receives representative digital data signals to and from the base microcontroller 44.

The base microcontroller 44 includes a processor 47 and a memory 48 including variable data 52 and an executable code 54. The processor 47 operates in a conventional manner according to instructions in the executable code 54 and digital values in the variable data 52 to receive and issue digital signals and to control the elements of the base station 40 via a microcontroller bus 56. The variable data 52 includes an identification (ID) list 58 including a base station ID 60 corresponding to the base station 40, the respective RMI ID 27–28 (FIG. 1) for the active RMIs 23–24 (FIG. 1), and the RMI ID 29 (FIG. 1) for the RMI 25 (FIG. 1) that is representative of the RMIs 12 (FIG. 1) that are enabled but not active. In a preferred embodiment the base station ID 60 corresponds to the serial number of the base station 40. The executable code 54 includes a communication code 62 and an installation code 64. The communication code 62 includes instructions for communicating with the active RMIs 23–24 and with the WAN interface 46 for passing data up to the central office 19 (FIG. 1) and control information down to the RMIs 23–24 and for scheduling the communications with the RMIs 23–24. The communication code 62 causes the base station 40 to alternate between a first or scheduled time segment for the scheduled communications and a second or acquisition time segment. In a preferred embodiment the scheduled time segment is two seconds and the acquisition time segment is four seconds for a cycle time of six seconds. The base station 40 receives a wireless data signal and typically responds by transmitting a wireless return signal to one of the scheduled RMIs 23–24 during each of the scheduled time segments enabling the base station 40 to have ten scheduled communications per minute. In an hour the base station 40 can serve up to six hundred different RMIs 23–24; one of the RMIs 23–24 six hundred times; or a combination of fewer than six hundred RMIs 23–24 where some of the RMIs 23, 24 are serviced more than once during the hour. The base stations 16 (FIG. 1) that communicate via the master station 21 (FIG. 1) have nine scheduled RMI communications per minute and use the tenth time for master station communication.

The installation code 64 includes instructions for installing or reinstalling the representative RMI 25 whose RMI ID 29 is currently in the ID list 58 and for receiving information for enabling the particular RMI 26 by adding the corresponding RMI ID 30 to the ID list 58 in preparation for installation. There are two ways in which the RMI ID 30 may be added. First, the RMI ID 30 may be downloaded from the central office 19 (FIG. 1) via the WAN 20 to the WAN interface 46 and passed by the WAN interface 46 to the base microcontroller 44. However, in several embodiments of the WAN 20, it is not practical for the field repair or installation person to get the attention of the central office 19 in order for the downloading to proceed. Second, and preferably, the RMI ID 30 is received in a wireless installation signal from the installer tool 18 (FIG. 1) as illustrated in the flow chart of FIG. 3 and described in the accompanying detailed description, below.

Figure 3:
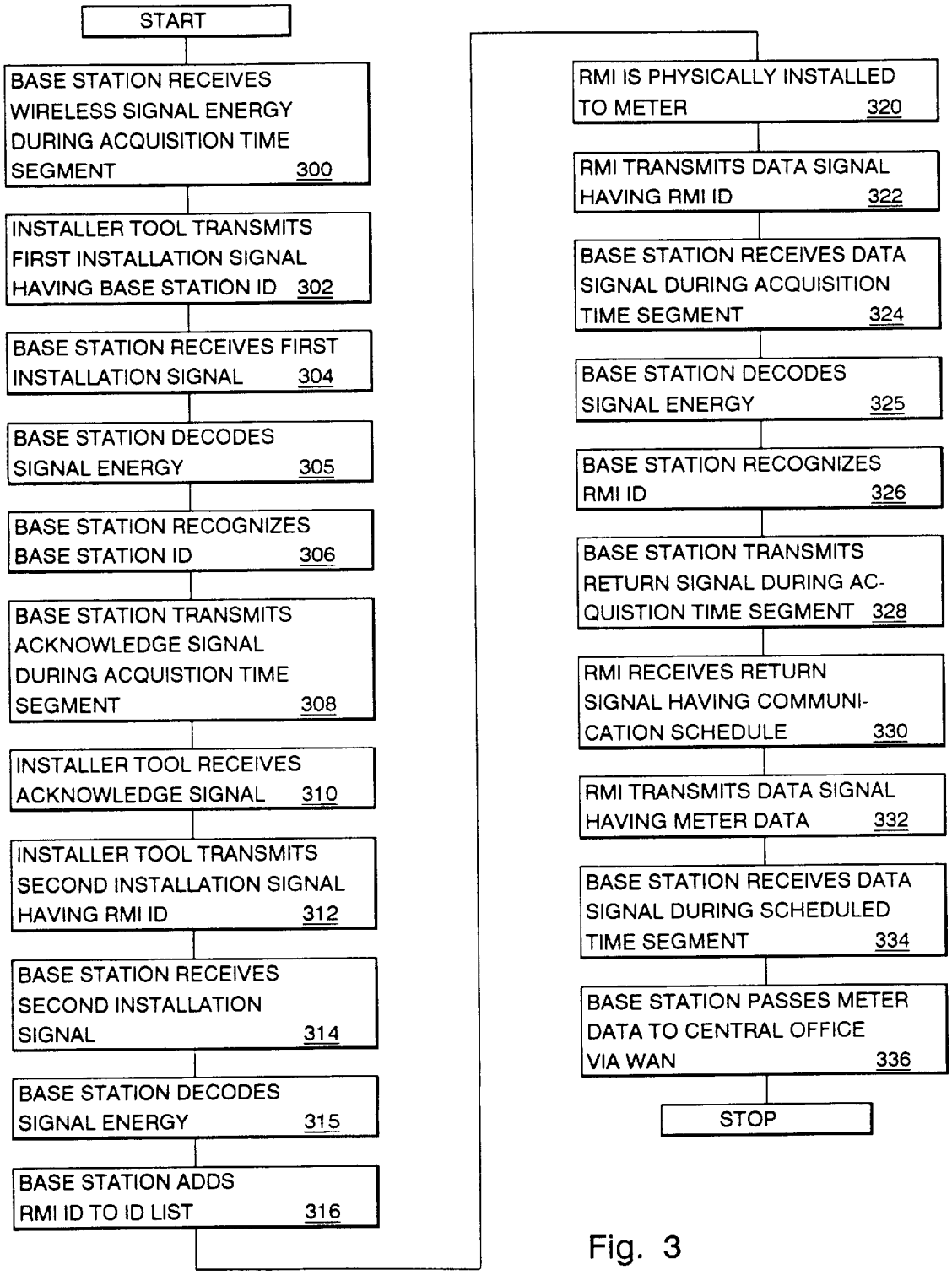
FIG. 3 is a flow chart of a method in the system of FIG. 1 whereby the installer tool enables the base station to communicate with the RMI.

FIG. 3 is a flow chart of the way in which the installer tool 18 and the base station 40 communicate for installing the RMI 26. In a step 300 the base station 40 is controlled by the communications code 62 to alternate between the scheduled time segment for scheduled communications with the RMIs 23–24 and the acquisition time segment. During the scheduled time segments the base station 40 is communicating with the RMIs 23 and 24. During the acquisition time segments the receiver/transmitter 42 is controlled by the base microcontroller 44 acting on instructions in the installation code 64 for receiving wireless signal energy at a frequency that is dithered about one of the channels that is used by the RMI 25 and/or the installer tool 18. In a preferred embodiment the frequency dither is approximately forty-five kilohertz. The particular channel is selected based upon a low background noise. When signal energy is received, the receiver/transmitter 42 demodulates and synchronizes to the received signal energy and passes a responsive digital signal to the base microcontroller 44. The base microcontroller 44 decodes the digital signal and follows instructions in the installation code 64 to attempt to recognize the RMI ID 29 or the base ID 60. In a step 302 the field repair or installation person inputs the base station ID 60 corresponding to the base station 40 into the installer tool 18 and the installer tool 18 transmits a first wireless installation signal burst including the base station ID 60. In a step 304 the base station 40 receives signal energy for the first installation signal during the acquisition time segment. In a step 305 the base station 40 decodes the first installation signal. In a step 306 the base station 40 recognizes its own base station ID 60. In a 308 the base station 40 responds during the acquisition time segment by transmitting an acknowledgment signal scheduling a time and a time cycle for future transmissions from the installer tool 18. These communications are scheduled during the acquisition time segment, thereby allowing the base station 40 to continue scheduled communications at full capacity. In a step 310 the installer tool 18 receives the acknowledgment signal. In a step 312 the field person inputs the RMI ID 30 corresponding to the RMI 26 into the installer tool 18 and the installer tool 18 responds at the scheduled time with a second wireless installation signal including information for the RMI ID 30. In a step 314 the base station 40 receives signal energy for the second installation signal burst during the acquisition time segment. In a step 315 the base station 40 decodes the signal energy for the second installation signal. In a step 316 the base station 40 follows instructions in the installation code 64 for adding the RMI ID 30 to the ID List 58. The base station 40 has now been enabled to communicate with the RMI 26 and will now attempt to recognize the RMI ID 30.

In an asynchronous step 320 before or preferably after the base station 40 has been enabled for the RMI ID 30, the field installation person physically installs the RMI 26 to read the corresponding meter 14. In a step 322 RMI 26 transmits a wireless data signal burst including its RMI ID 30. In a preferred embodiment, when the RMI 26 is being installed for the first time, the data signal burst has three predetermined frequency channels for frequency hopping. When the RMI 26 is being re-installed after operating at some previous time the data signal burst has fifty predetermined frequency channels for frequency hopping. In a step 324 the base station 40 receives signal energy for the wireless data signal during the acquisition time segment. In a step 325 the base station 40 decodes the signal energy for the data signal. In a step 326 the base station 40 recognizes the RMI ID 30. In a step 328 the base station 40 responds by transmitting a wireless return signal to the RMI 26 to schedule future communications during the scheduled time segment. The return signal burst is transmitted using the actual frequency and actual time of the wireless data signal as the basis for the frequency of the wireless return signal. In a step 330 the RMI 26 receives the return signal burst. In a step 332 the RMI 26 transmits a wireless data signal including application data read from the corresponding meter 14. In a step 334 the base station 40 receives the wireless data signal including the application data. In a step 336 the base station 40 passes the application data via the WAN 20 to the central office 19. The installer tool 18 and the base station 40 may continue to communicate during the acquisition time segment while the RMIs 23, 24, and 26 and the base station 40 are communicating during the scheduled time segment. Communications from the base station 40 to the installer tool 18 may include information that signals from the RMIs 23, 24, and 26 are or are not being received, power levels, information for how often the scheduled communications were not received, the power levels from the RMIs 23, 24, and 26, the power outages at the base station 40, and other health and diagnostic information from the RMIs 23–26 and base station 40. Communications from the installer tool 18 to the base station 40 may include the desired scheduling interval for the RMI 23–26, the initial dial reading for the RMI 26 for the corresponding meter 14, and other parameters and diagnostic information intended for the RMIs 23–26 and the base station 40.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A method for communicating with remote interfaces, comprising steps of:

organizing time in a repeater station for alternating between scheduled time segments allocated to scheduled ones of said remote interfaces for scheduled communications with said scheduled remote interfaces and acquisition time segments for unscheduled communications with unscheduled ones of said remote interfaces, one of said scheduled time segments alternating with one of said acquisition time segments;

allocating a first of said scheduled time segments in said repeater station to a first of said scheduled remote interfaces having a first identification;

initiating a first of said scheduled communications within said first scheduled time segment by transmitting a data signal having sensor data and said first identification from said first scheduled remote interface;

receiving first scheduled time segment signal energy including said data signal at said repeater station during said first scheduled time segment;

transmitting a repeater signal including said sensor data from said repeater station when said first identification is detected in said first scheduled time segment signal energy;

receiving said repeater signal at a master station; and transmitting said sensor data from said master station for use by a central office.

2. The method of claim 1, further comprising a step of:

transmitting a return signal from said repeater station to said first scheduled remote interface during said first scheduled time segment when said data signal having said first identification is detected in said first scheduled time segment signal energy.

3. The method of claim 1, further comprising steps of:

storing installed identifications in said repeater station, said installed identifications corresponding respectively to certain ones of said remote interfaces;

initiating a first of said unscheduled communications within a first of said acquisition time segments by transmitting an acquisition signal having a second identification from a first of said unscheduled remote interfaces;

receiving first acquisition time segment signal energy including said acquisition signal at said repeater station during said first acquisition time segment; and transmitting a return acquisition signal from said repeater station to said first unscheduled remote interface during said first acquisition time segment when said acquisition signal is detected and said second identification matches any one of said installed identifications.

4. The method of claim 3, wherein:

said acquisition signal has a frequency hop pattern having an actual carrier frequency in each said unscheduled communication, respectively, said actual carrier frequency intended to be one of a set of expected carrier frequencies as determined by a frequency hop pattern associated with said first unscheduled remote interface; and the step of receiving said first acquisition time segment signal energy includes dithering in a dither range about a particular one of said expected carrier frequencies of said frequency hop pattern for detecting said acquisition signal when said actual carrier frequency is within said dither range of said expected carrier frequency.

5. The method of claim 3, further including steps of:

providing additional repeater stations with overlapping receiving ranges for said remote interfaces;

storing installed identifications in said repeater stations, all of said installed identifications in each one of said repeater stations different than any one of said installed identifications in each other of said repeater stations; and in said each one of said repeater stations, ignoring said acquisition signal when said second identification does not match any one of said installed identifications in said one of said repeater stations, whereby communication with each of said remote interfaces is acquired through only one of said repeater stations.

6. The method of claim 1, wherein:

the step of organizing time includes allocating a particular one said scheduled time segments for repeater communication between said repeater station and said master station; and the step of transmitting said repeater signal includes transmitting said repeater signal during said particular one of said scheduled time segments allocated to said repeater communication.

7. A communication system having remote interfaces, comprising:

a repeater station including a base processor for storing a first identification and organizing time for alternating between scheduled time segments allocated to scheduled ones of said remote interfaces for scheduled communications with said scheduled remote interfaces and acquisition time segments for unscheduled communications with unscheduled ones of said remote interfaces, one of said scheduled time segments alternating with one of said acquisition time segments;

a first of said scheduled remote interfaces for initiating said scheduled communications within a first of said scheduled time segments allocated to said first scheduled remote interface by transmitting a data signal having sensor data and said first identification;

the repeater station further including a base receiver coupled to said base processor for receiving first scheduled time segment signal energy during said first scheduled time segment and a base transmitter coupled to said base processor for transmitting a repeater signal including said sensor data when said data signal having said first identification is detected in said first scheduled time segment signal energy; and a master station for receiving said repeater signal and transmitting said sensor data for use by a central office.

8. The system of claim 7, wherein:

said base transmitter is further for transmitting a return signal to said first scheduled remote interface during said first scheduled time segment when said data signal having said first identification is detected in said first scheduled time segment signal energy.

9. The system of claim 7, further comprising:

a first of said unscheduled remote interfaces for initiating a first of said unscheduled communications within a first of said acquisition time segments by transmitting an acquisition signal having a second identification;

said base receiver is further for receiving first acquisition time segment signal energy during said first acquisition time segment;

said base processor is further for storing installed identifications corresponding respectively to certain ones of said remote interfaces; and said base transmitter is further for transmitting a return acquisition signal to said first unscheduled remote interface during said first acquisition time segment when said second identification matches any one of said installed identifications.

10. The system of claim 9, wherein:

said acquisition signal has a frequency hop pattern having an actual carrier frequency in each said unscheduled communication, respectively, said actual carrier frequency intended to be one of a set of expected carrier frequencies as determined by a frequency hop pattern associated with said first unscheduled remote interface; and said base receiver is further for dithering in a dither range about a particular one of said expected carrier frequencies of said frequency hop pattern for detecting said acquisition signal when said actual carrier frequency is within said dither range of said expected carrier frequency.

11. The system of claim 9, further comprising:

several additional repeater stations with overlapping receiving ranges for said remote interfaces, said additional repeater stations for storing installed identifications, all of said installed identifications in each one of said repeater stations different than any one of said installed identifications in each other of said repeater stations, each one of said repeater stations for ignoring said acquisition signal when said second identification does not match any one of said installed identifications in said one of said repeater stations, whereby communication with each of said remote interfaces is acquired through only one of said repeater stations.

12. The system of claim 7, wherein:

said base processor is further for allocating a particular one of said scheduled time segments for repeater communication between the repeater station the said master station; and said base transmitter is further for transmitting said repeater signal during said particular one of scheduled time segments allocated to said repeater communication.

* * * * *